United States Patent [19]

Betsinger et al.

[11] 4,396,155

[45] Aug. 2, 1983

[54] SHOWER HEAD

[75] Inventors: James D. Betsinger, South Bend, Ind.; James P. Bailey, Batavia, Ill.

[73] Assignee: Adroit Products Corporation, St. Clair Shores, Mich.

[21] Appl. No.: 297,624

[22] Filed: Aug. 31, 1981

Related U.S. Application Data

[62] Division of Ser. No. 85,722, Oct. 17, 1979, Pat. No. 4,295,612.

[51] Int. Cl.[3] ..... B05B 1/18

[52] U.S. Cl. ..... 239/499; 239/318

[58] Field of Search ..... 239/281, 305, 318, 310, 239/587, 499, 504, 518

[56] References Cited

U.S. PATENT DOCUMENTS 2,900,139 8/1959 Hensley, Jr. ..... 239/499

4,121,773 10/1978 Headen et al. ..... 239/318

4,145,004 3/1979 Krizik ..... 239/499

*Primary Examiner*—James B. Marbert

*Attorney, Agent, or Firm*—Barnes, Kisselle, Raisch, Choate, Whittemore & Hulbert

[57] ABSTRACT

A shower head comprising a first part adapted to be connected to a source of water and a second part mounted on the first part for pivotal movement about a transverse axis. The second part has an opening adapted to be aligned with an opening in the first part. The opening in the second part has a venturi-shaped portion. A third part is telescoped over and surrounds the second part and defines a pressure chamber into which water is directed from the venturi. The third part has a plurality of openings therein and a passage extends from the restricted portion of the venturi to the exterior for attachment to a fluid dispenser.

3 Claims, 2 Drawing Figures

SHOWER HEAD

This application is a division of application Ser. No. 085,722 filed Oct. 17, 1979, now U.S. Pat. No. 4,295,612.

This invention is directed to an improved shower head.

BACKGROUND AND SUMMARY OF THE INVENTION

In accordance with the invention, the shower head comprises a first part adapted to be connected to a source of water, a second part and means for mounting the second part on said first part for pivotal movement about a transverse axis. The second part has an opening adapted to be aligned with an opening in the first part. The opening in the second part has a venturi-shaped portion. A third part is telescoped over and surrounds the second part and defines a pressure chamber into which water is directed from said venturi. The third part having a plurality of openings therein and a passage extends from the restricted portion of the venturi to the exterior.

DESCRIPTION

Figure 2:
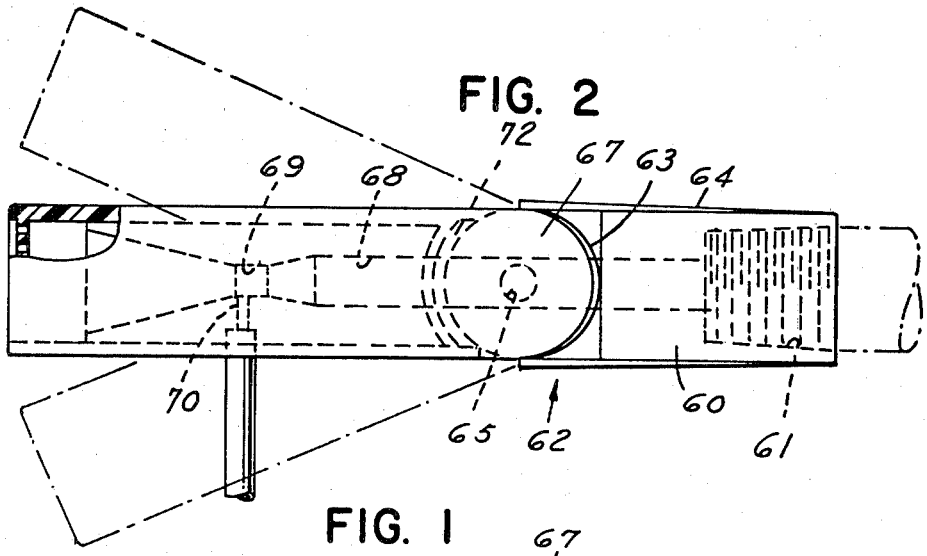
FIG. 2 is a side elevational view of the same.
Figure 1:
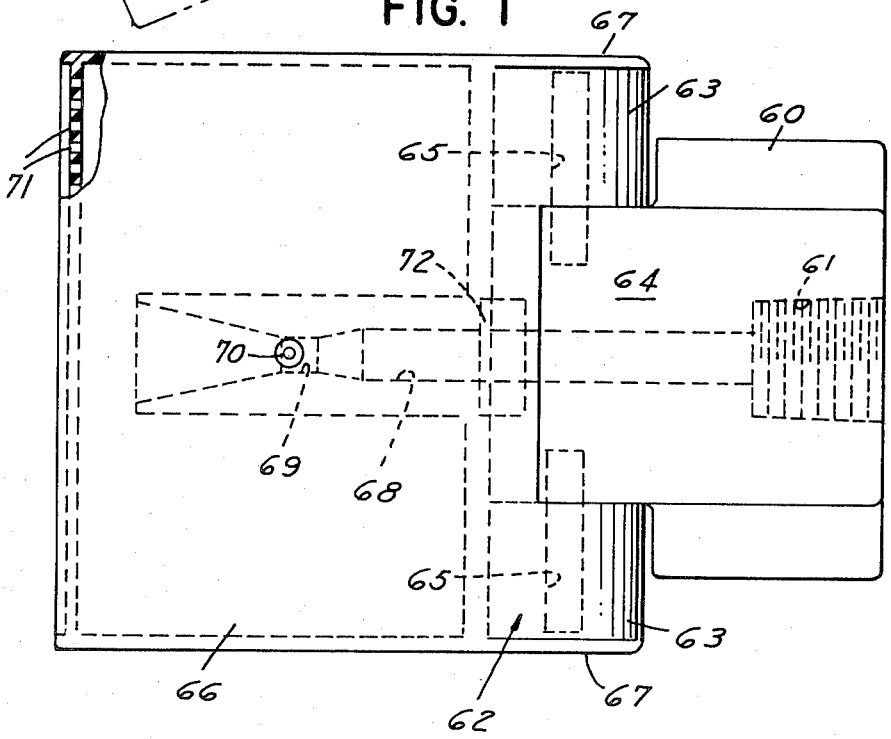
FIG. 1 is a plan view of a shower head embodying the invention.

The shower head embodying the invention comprises a first part 60 (FIG. 1) made of plastic having an opening 61 therethrough which is adapted to be attached to the source of water and a second part 62 pivotally connected to the part 60 so that it is angularly movable as shown in FIG. 2. More specifically, the part 62 includes spaced portions 63 which are aligned with a central portion 64 of the part 60 and pivot pins 65 extend through openings in the portion 63 and 64. The shower head further includes a third part 66 that telescopes over the part 62 and has portions 67 overlying the portions 63 and pins 65. The part 62 includes an opening 68 which is aligned with the opening 61 and has a venturi 69 and orifice 70 communicating with a restricted portion of the venturi to which the suction line is attached. The suction line 70 extends to a chamber for dispensing diverse liquids such as shampoo, body oil and the like as disclosed in the aforementioned application Ser. No. 085,722 which is incorporated herein by reference. The part 66 further includes a plurality of openings 71.

The parts 60, 62, 66 are preferably made of a suitable plastic and the portions 67 are connected to the portions 63 by use of adhesive or ultrasonic bonding.

In use, the water flowing the opening 61 and in turn the opening 68 and venturi 69 passes to a chamber defined by the part 66 surrounding the part 62 and then out through the openings 71. The suction formed at orifice 70 functions to draw the selected liquid from one of the reservoirs in the apparatus and it passes outwardly into the chamber mixing with the water and being dispensed through the openings 71.

The parts 61, 62 have generally arcuate cooperating cylindrical surfaces and a seal 72 is provided therebetween.

We claim:

1. A shower head comprising a first part adapted to be connected to a source of water, a second part, means for mounting said second part on said first part for pivotal movement about a single transverse axis such that the second part pivots solely about said single transverse axis, said second part having an opening adapted to be aligned with an opening in said first part, said opening in said second part having a venturi-shaped portion, a third part telescoping over and surrounding said second part and defining a pressure chamber into which water is directed from said venturi, said third part having a wall with a plurality of openings therein extending from said chamber to the exterior, a passage extending from the restricted portion of said venturi to the chamber.

2. The shower head set forth in claim 1 wherein said means for pivotally connecting said first part to said second part comprises cooperating arcuate cylindrical surfaces on said first and second part, seal means between said first and second part at said surfaces surrounding the openings therein, said second part having spaced portions thereof aligned with a portion of said first part, said first part and said spaced portions having aligned openings, pivot pins positioned in said openings in said aligned portions, said third part having portions thereof extending and overlying the pivot pins.

3. The shower head set forth in claims 1 or 2 wherein said first, second and third parts are made of plastic.

* * * * *